US006233947B1

(12) United States Patent
Madni et al.

(10) Patent No.: US 6,233,947 B1
(45) Date of Patent: May 22, 2001

(54) HIGH EFFICIENCY FUZZY LOGIC BASED STIRLING CYCLE CRYOGENIC COOLER

(75) Inventors: Asad M. Madni, Los Angeles; Jim B. Vuong, Northridge; Lawrence A. Wan, Malibu, all of CA (US)

(73) Assignee: BEI Sensors & Systems, Inc., Sylmar, CA (US)

( * ) Notice: Subject to any disclaimer, the term of this patent is extended or adjusted under 35 U.S.C. 154(b) by 0 days.

(21) Appl. No.: 09/432,999

(22) Filed: Nov. 2, 1999

(51) Int. Cl.[7] ..... F25B 9/00; F01B 29/10
(52) U.S. Cl. ..... 62/6; 60/520
(58) Field of Search ..... 62/6; 60/520

(56) References Cited

U.S. PATENT DOCUMENTS 5,734,593 * 3/1998 Madni et al. ..... 395/61
5,752,385 * 5/1998 Nelson ..... 62/6
6,084,320 * 7/2000 Morita et al. ..... 62/6

* cited by examiner

*Primary Examiner*—William Wayner
(74) *Attorney, Agent, or Firm*—Jerry G. Wright; Flehr, Hohbach, Test, Albritton & Herbert LLP

(57) ABSTRACT

A high efficiency fuzzy logic based Stirling cycle cryogenic cooler has increased efficiency by driving the system in the demand mode (near the desired set point cooling temperature) by a more efficient sinusoidal waveform. The compressor pistons of the Stirling compressor are driven by a voice coil actuator between compressing the coolant gas and then releasing and being driven against an opposing return spring. Since a square wave provides faster cool-down, this is utilized during that mode. In addition, to utilize the rebound effect of both the ambient gas pressure and the return springs, the voice coil actuator drive is turned off during one-quarter cycle rebound portions of the cooling cycle.

4 Claims, 4 Drawing Sheets

HIGH EFFICIENCY FUZZY LOGIC BASED STIRLING CYCLE CRYOGENIC COOLER

INTRODUCTION

The present invention is direction to a high efficiency fuzzy logic based Stirling cycle cryogenic cooler which is particularly useful for night vision and medical applications.

BACKGROUND OF THE INVENTION

Cryogenic refrigerators have been used since the 1960's for infrared detector cooling (for example, for military use). The compressor portion of the Stirling cryogenic cooler consists of two sets of pistons and springs that are placed 180° out of phase with respect to each other. This is schematically illustrated in FIG. 2 as will be discussed later. In order to improve a mean time to failure operation, Madni U.S. Pat. No. 5,734,593 discloses a fuzzy logic controller for such a system which provides a control output signal which controls the final cooling power of the cooler-compressor of the Stirling system. Such output signal, as disclosed in the Madni '593 Patent, is a pulse width modulated (PWM) signal of the square wave type.

In driving a compressor, especially of the Stirling type, it is known that a sine wave drive, for example, accomplished by a rotating wheel and crank, is preferable for some modes of operation. However, in a cryogenic system as used in the present applications, that is an infrared detector, or in medical applications, both power requirements and size would effectively eliminate the use of such a sinusoidal drive.

OBJECT AND SUMMARY OF INVENTION

It is therefore a general object of the invention to provide a high efficiency fuzzy logic based Stirling cycle cryogenic cooler.

In accordance with the above object, there is provided a cryogenic cooling system where a Stirling cycle cooler-compressor having opposed pistons is used for circulating a coolant fluid to a cold tip, having an actual temperature, TC, which is in proximity to the object being cooled, the cooler-compressor cooling the fluid to a predetermined set point temperature, TS, and including a fuzzy logic controller responsive to AT, the difference between TS and TC, for providing an output control signal to the cooler-compressor, the system comprises means for generating during a cool down mode an output control signal of a square wave type having maximum cooling power. Means for generating during a demand mode an output control signal of the sinusoidal type are also provided as well as means for switching, in response to a predetermined AT value from the cool down to the demand mode and vice versa.

In another embodiment of the invention, the pistons of the cooler have spring returns in opposition to the ambient pressure of the coolant fluid for placing them in a neutral position and the sine wave generator is effectively turned off every one-quarter cycle after reaching a peak to allow the ambient cooling fluid pressure or the springs to return the pistons to a neutral position.

DETAILED DESCRIPTION OF PREFERRED EMBODIMENTS

Figure 1:
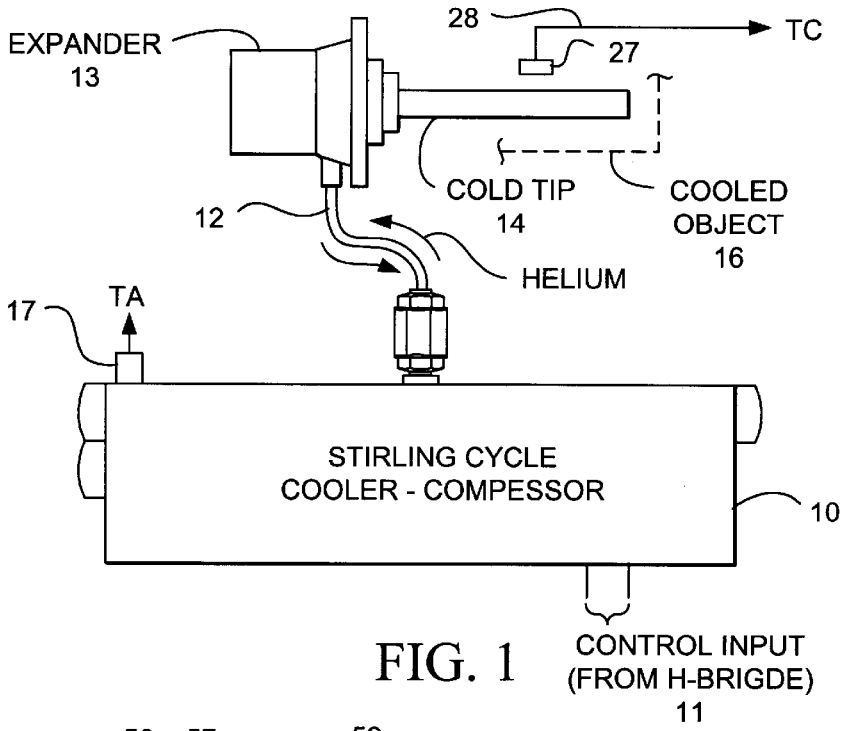
FIG. 1 is a block diagram of the hardware components of a typical Stirling cycle cryogenic cooling system.

FIG. 1 illustrates a Stirling cycle cooler which includes a Stirling cycle cooler-compressor whose pistons are driven by a control input 11 from an H-bridge or output driver as will be discussed in conjunction with FIG. 5. The cooler-compressor is connected by coupling 12 which carries helium gas coolant in both directions as shown by the arrows to an expander 13 where it provides for a cooling of a cold tip 14. The cold tip is placed in proximity to a cooled object 16 which may be, for example, an infrared detector or a medical device. As thus far described, this is also shown in the above patent and is commercially available. However, the control input 11, which as disclosed in the above-referenced patent is a pulse width modulated square wave type signal, has been modified in accordance with the present invention. Continuing with discussion of FIG. 1, there is an air temperature sensor 11 to provide an ambient temperature, TA, and also a cold tip sensor 27 at the end of the cold tip 14 to provide a cold tip temperature, TC, on line 28. In operation, the desired temperature is the set point temperature, TS.

Figure 2:
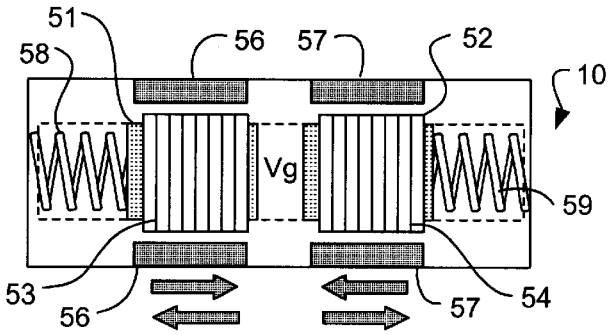
FIG. 2 (PRIOR ART)
FIG. 2 is a simplified cross-sectional view of a prior art compressor drive system used in the system of FIG. 1.

As illustrated in FIG. 2, the actual basic structure of the Stirling cryo-cooler-compressor 10 consists of two sets of pistons and springs that are placed 180° out of phase with respect to each other. Thus, one of the piston pairs is indicated at 51 and the other at 52. The pistons are actually moved by voice coil inductors 53 and 54 which utilizes the permanent magnetic fields provided by the magnet pairs 56 and 57. The purpose of the compressor pistons is, of course, to compress the helium coolant which is indicated in a gaseous form as $V_g$. The pistons are also attached to a pair of coil springs 58 and 59 which serve the purposes of maintaining the position of the coil assembly centered relative to the magnets 56 and 57; that is, in a neutral position. They also limit the travel of the pistons to prevent them from hard hits at the end of the cavity. In addition, an important feature of the springs is the manner in which they are used to achieve resonance for the spring mass assembly to be equal to the drive frequency. In other words, the springs are matched to the characteristics of the compressing gas, $V_g$. Driving at resonance results in the best efficiency and the motion of the piston is based on the voice coil type of actuator utilized here. Such voice coil piston is governed by the Lorentz force principle. As stated above, all of the components of FIG. 2 are commercially available.

Figure 3A:
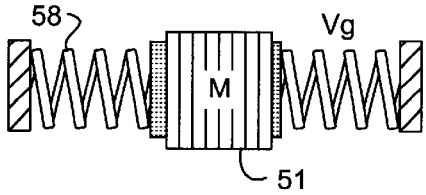
FIGS. 3*a*, 3*b* and 3*c* are side elevational views illustrating the operation of the pistons of FIG. 2.
Figure 3B:
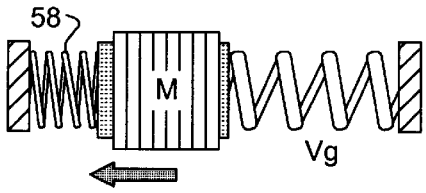
Figure 4:
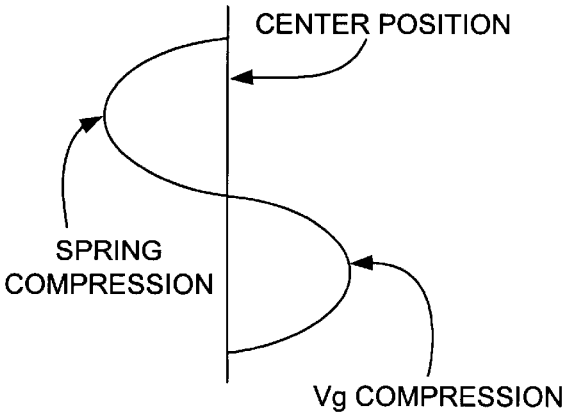
FIG. 4 is a characteristic waveform illustrating the operation of FIGS. 3*a*, 3*b* and 3*c;*
Figure 3C:
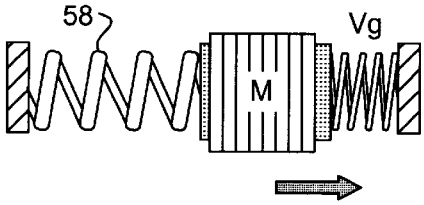

The theoretical operation of FIG. 2 is illustrated in FIGS. 3*a*, 3*b* and 3*c* which show a single piston unit simulation having a mass, M (for example, piston 51), with the spring coil 58 at the left side and the gas $V_g$, on the right. The compression of the gas is made equal to the compression of the spring, and the expansion of the gas is equivalent to the tension of the spring. Thus, as illustrated in FIG. 4, the center position of the piston in FIG. 3*a* is designated "center position." With the spring 58 compressed as in FIG. 3*b*, this is illustrated with the "spring compressed" sine wave and with the gas compressed as in FIG. 3*c*, and this is illustrated as "$V_g$ compressed." When an alternating current is applied to the voice coil inductor, it produces the movement as illustrated in FIG. 4 which is, of course, a sinusoidal waveform. As will be discussed below, when driving the piston it is believed that the sinusoidal waveform is the most efficient in the demand mode where the cold tip temperature, TC, is near the set point temperature, TS; for example, 10° K. Thus, for an infrared detector, 78° K is the desired set point temperature.

Figure 5:
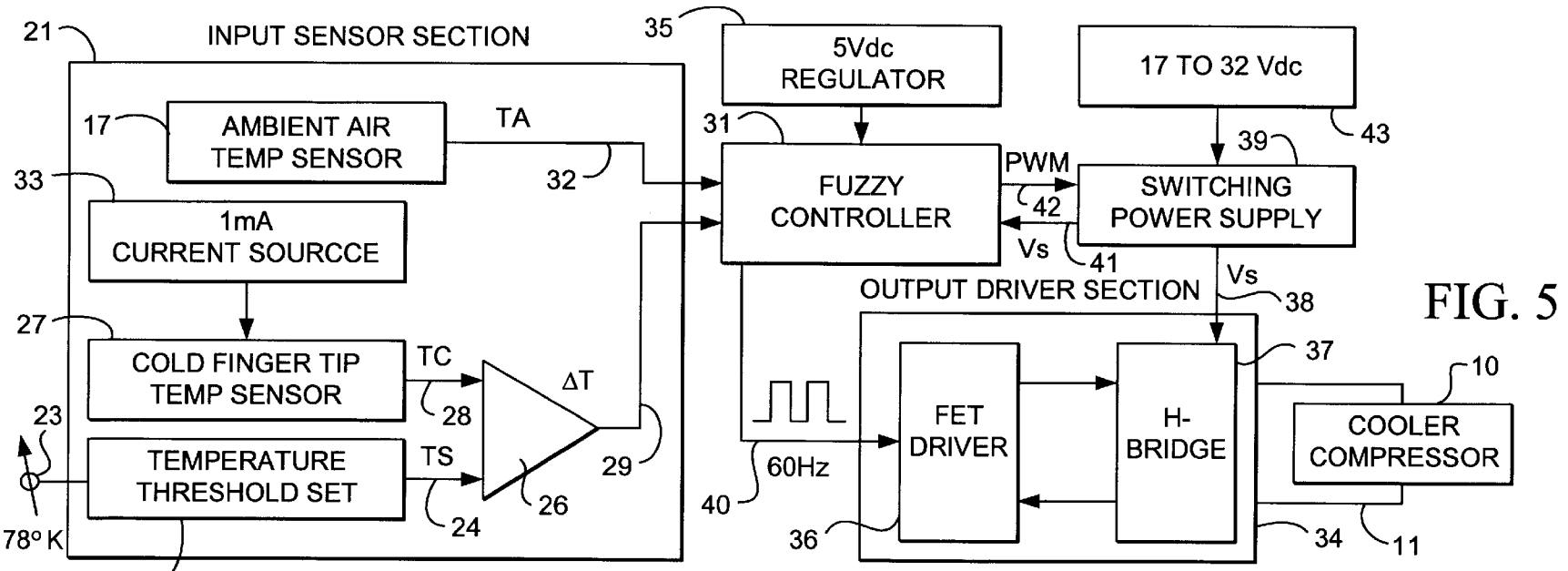
FIG. 5 is an overall simplified block diagram of a fuzzy logic based controller used for controlling the power applied to the cooler-compressor of FIG. 1.
Figure 6:
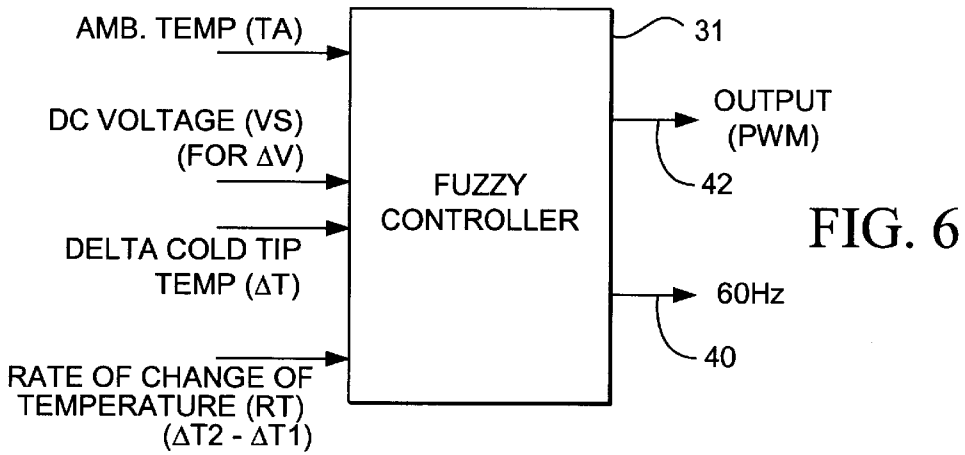
FIG. 6 is a simplified block diagram of a portion of FIG. 5 showing the inputs and outputs of the fuzzy controller.

FIG. 5 illustrates the general operation of the invention as also shown in the above-referenced patent. Here, the input sensor section 21, which is a portion of the overall micro-controller unit of the present invention, includes a temperature threshold set unit 22 having a variable input 23 to provide the set point or predetermined temperature, TS, on the line 24 to the comparator 26. Then, the cold tip temperature sensor 27 is indicated having on line 28 the cold tip temperature, TC. These two are compared and their difference is on the AT output 29 of the comparator 28 which is an input to the fuzzy to provide maximum energy to the compressor while, of course, at the same time the DC supply voltage to the driver is limited to a specific value. Alternatively, in the demand mode since the movement of the piston is a sinusoidal motion as discussed above, although a square wave driver can perform accurate temperature control, there is wasted energy at the beginning and end of each piston movement. Thus, a sine wave type PWM driver signal results in a better performance.

Figure 7:
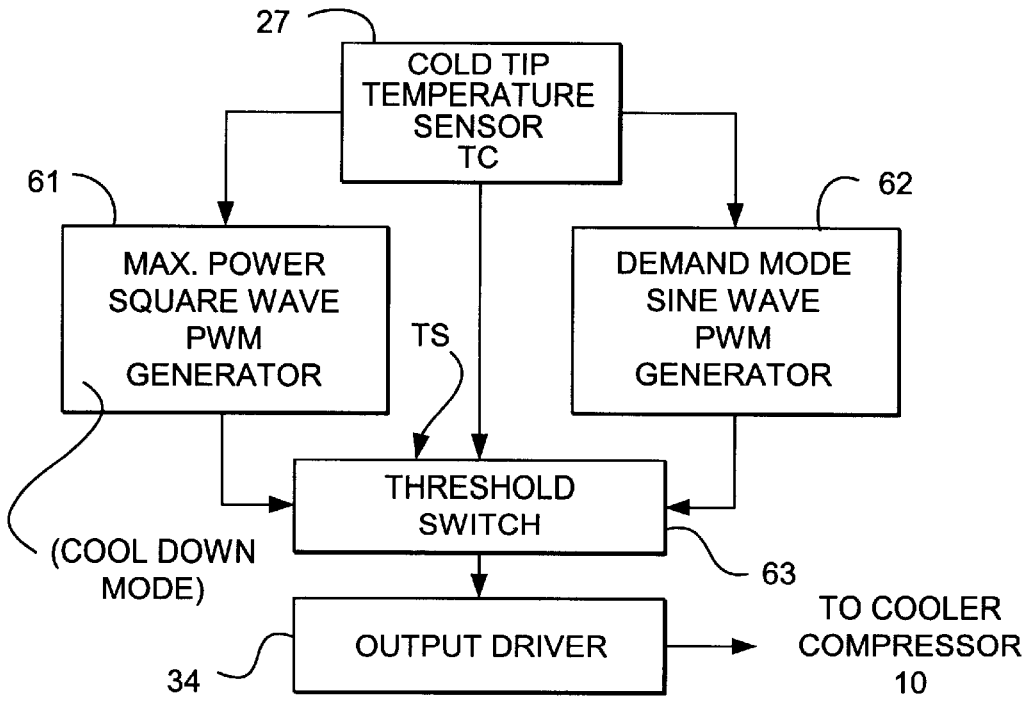
FIG. 7 is a detailed block diagram of the switching power supply of FIG. 5.

To achieve the foregoing type of operation, FIG. 7 illustrates in a hardware format the switching between the output driver 34 (see FIG. 5) of a maximum power square wave generator 61 used in the cool-down mode and a sine wave PWM generator 62 used in the demand mode. A switch is made as shown at 63 (all of the foregoing is actually accomplished in software) by computing the ΔT between TS and TC and when, for example an effective temperature difference of, for example, 10° K is reached, a switch is made from cool-down to demand mode. From a practical standpoint, this temperature difference ΔT may be expressed as a voltage also.

The performance with these two different driver waveforms has been computed. With a square type waveform in the cool-down mode, 3.5 minutes at 24 watts power was required. In the sinusoidal mode, a longer period of time of 5.5 minutes at 19.5 watts. Thus, although the sinusoid efficiency for cool-down was relatively better, it required a higher DC supply voltage and longer time to reach the set temperature. In contrast, in the demand mode, for example, where the temperature is 78°±1° K, a square wave for this operation required 14 watts and the sine wave was more efficient at 12 watts. Thus, combining the two types of waves, square wave and sine wave, provides for the most rapid cool-down with the square wave and, then during continuous demand mode operation a sine wave has higher efficiency.

Figure 8:
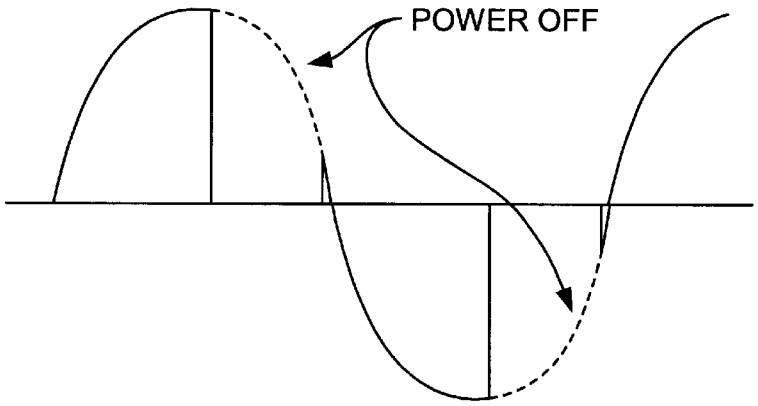
FIG. 8 illustrates a modified sine wave in accordance with the present invention which is used as a compressor driver.

For even greater efficiency, during the demand mode, the sine wave generator 62 may be modified (on a software basis) to provide the control signal as illustrated in FIG. 8 where the sine wave generator is effectively turned off or, rather the power is turned off every one-quarter cycle, allowing the piston to return under the force of either the return springs or the pressurized helium cooling fluid.

Figure 9:
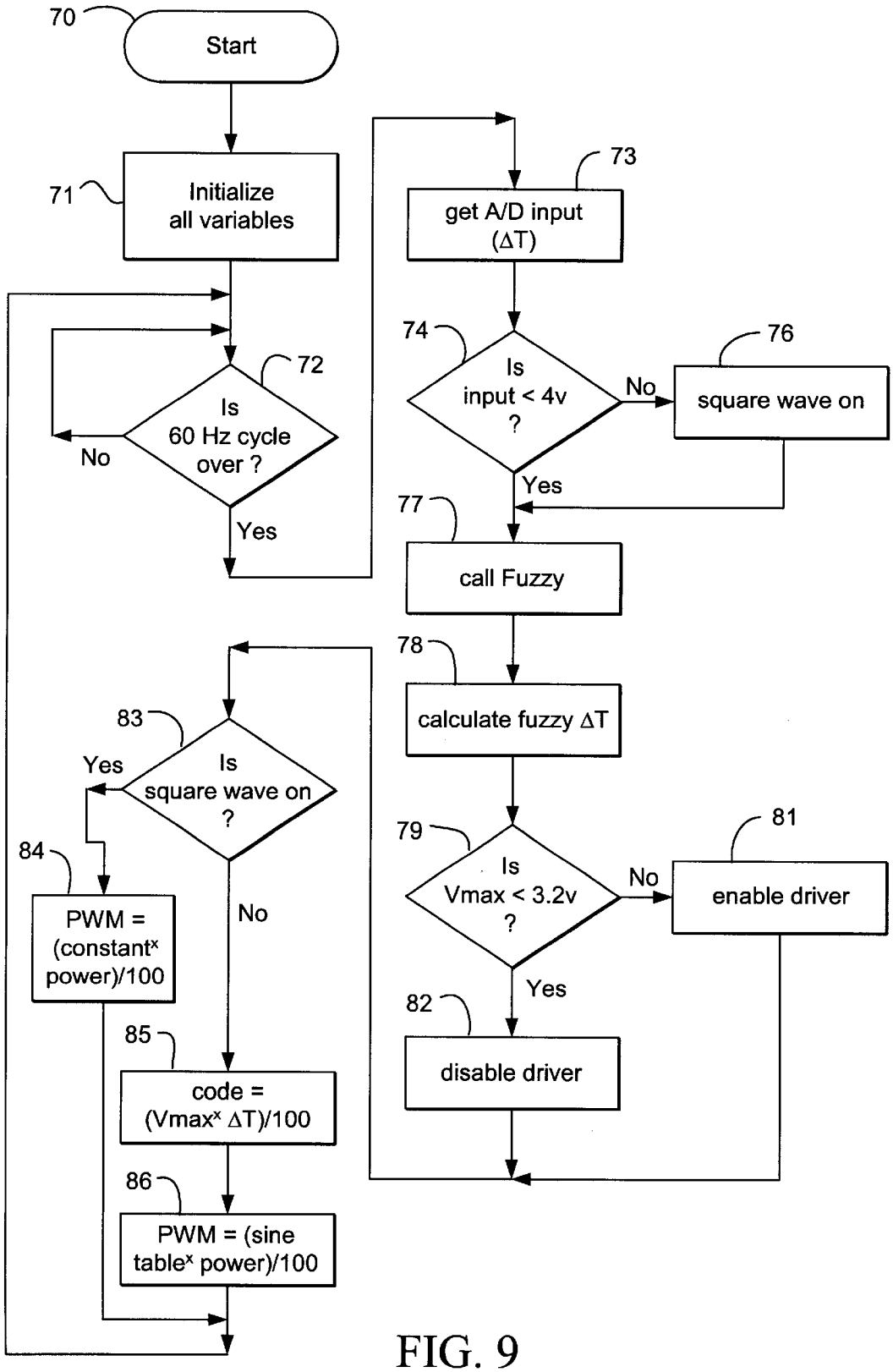
FIG. 9 is a flow chart illustrating the operation of FIGS. 7 and 8.

Referring now to the software flow chart of FIG. 9, this shows the actual implementation of the operations of FIGS. 7 and 8. This software is implemented in the fuzzy logic controller 32 in combination with the switching power supply 39. At step 70, start is given and at 71 all variables are initialized. Then in step 72, the question is asked—is 60 Hz half-cycle over? This is for the purpose of updating the software every half cycle. If no, a return is made; if "yes", then in step 73 an analog-to-digital input is gotten which is actually ΔT which is the difference between the actual cold tip temperature, TC, and the set point temperature, TS. Then in step 74, this difference is actually sensed as a voltage difference and the threshold question is—is the input less than 4 volts; the 4 volts would correspond to, for example, a 10° K difference between the desired cold tip temperature, TS, and the actual temperature and thus this step serves as a type of threshold switch 63 as in FIG. 7. Thus, it is the switching signal between the demand mode and the cool-down mode. If the cool-down mode is still desired, then in step 76 the square wave PWM signal is allowed to drive the cooler-compressor 10 via the output driver section 34, as illustrated in FIG. 5. The program continues at step 77 to calculate the fuzzy controller logic value which is calculated in step 78 with the ΔT. In steps 79, 81 and 82 is determined whether the drive voltage is greater or less than its max. This is fully discussed in the above-referenced patent and does not specifically relate to the present invention. Next, in step 83 the question is asked—is the square wave on—and, if it is, in step 84 a square wave is generated which is illustrated as a constant times power/100, that is, the power level is gotten from the fuzzy logic controller which then describes the maximum level of the square wave. However, if the square wave is "not on" (the other output of step 83), this means that the threshold level in step 74 has determined that the demand mode is now to be used. Thus, in step 84, a code is generated relating $V_{max}$ the maximum voltage to ΔT and this drives in step 86 a sine wave look-up table for a sine type PWM drive signal where the sine table provides the sine wave and the power of that sine wave is determined by the fuzzy logic controller. The look-up table is illustrated below.

LOOK-UP SINE TABLE

| TIME INCREMENTS | VALUE |
|---|---|
| 1 | 4 |
| 2 | 4 |
| 3 | 4 |
| 4 | 5 |
| 5 | 5 |
| 4 | 5 |
| 6 | 5 |
| 7 | 5 |
| 8 | 6 |
| \\\ | \\\ |
| 11 | 6 |
| 12 | 7 |
| \\\ | \\\ |
| 16 | 7 |
| 17 | 8 |
| \\\ | \\\ |
| 21 | 8 |
| 22 | 9 |
| \\\ | \\\ |
| 28 | 9 |
| 29 | 10 |
| \\\ | \\\ |
| 121 | 10 |

-continued

| LOOK-UP SINE TABLE | |
|---|---|
| TIME INCREMENTS | VALUE |
| 122 | 0 |
| \\\ | \\\ |
| 159 | 0 |

The look-up table in addition to providing the sine wave (note the increase of the values from 4 to 10) also provides the characteristic of FIG. 8 where the power is off at its 0 value for the last half of each positive and negative sine wave portion. The time increments illustrated as 1 through 159 are related to the 180° of a actual sine wave; that is, a positive or negative portion. As is obvious, the 0 values as illustrated do not theoretically utilize half of the time increments. However, this is because the sine table has been empirically adjusted to compensate for inertia and time delays in the actual physical operating Stirling cooler-compressor.

Thus, a high efficiency fuzzy logic based Stirling cycle cryogenic cooler has been provided.

What is claimed is:

1. A cryogenic cooling system where a Stirling cycle cooler-compressor having opposed pistons is used for circulating a coolant fluid to a cold tip, having an actual temperature, TC, which is in proximity to the object being cooled, the cooler-compressor cooling the fluid to a predetermined set point temperature, TS, and including a fuzzy logic controller responsive to ΔT, the difference between TS and TC, for providing an output control signal to said cooler-compressor said system comprising:

means for generating during a cool down mode a said output control signal of a square wave type having maximum cooling power;

means for generating during a demand mode a said output control signal of the sinusoidal type; and means for switching, in response to a predetermined ΔT value from said cool down to said demand mode and vice versa.

2. A cryogenic cooling system as in claim 1 where said pistons have spring returns in opposition to ambient pressure of said coolant fluid for placing them in a neutral position, and where said sine wave generator is effectively turned off every one-quarter cycle after reaching a peak to allow said ambient cooling fluid pressure or said springs to return said pistons to said neutral position.

3. A cryogenic cooling system, as in claim 2 where said springs and cooling fluid pressure are balanced to provide a predetermined resonant frequency of operation of said pistons.

4. A cryogenic cooling system where a Stirling cycle cooler-compressor having opposed pistons is used for circulating a coolant fluid to a cold tip, having an actual temperature, TC, which is in proximity to the object being cooled, the cooler-compressor cooling the fluid to a predetermined set point temperature, TS, and including a fuzzy logic controller responsive to ΔT, the difference between TS and TC, for providing an output control signal to said cooler-compressor said system comprising:

means for generating a said output control signal of the sinusoidal type, said pistons having spring returns in opposition to ambient pressure of said coolant fluid for placing them in a neutral position and where said sine wave generator is effectively turned off every one-quarter cycle after reaching a peak to allow said ambient cooling fluid pressure or said springs to return said pistons to said neutral position.

* * * * *